US008041269B2

(12) United States Patent
Kubo et al.

(10) Patent No.: US 8,041,269 B2
(45) Date of Patent: Oct. 18, 2011

(54) DEVELOPMENT APPARATUS HAVING TWO DEVELOPER BEARERS AND TWO DEVELOPMENT CHAMBERS

(75) Inventors: Tatsuya Kubo, Tokyo-to (JP); Yoshitaka Fujinuma, Tokyo-to (JP); Takashi Suzuki, Tokyo-to (JP); Susumu Tateyama, Tokyo-to (JP); Tsutomu Nakagawa, Tokyo-to (JP); Masayoshi Nakayama, Tokyo-to (JP)

(73) Assignee: Ricoh Co., Ltd., Tokyo (JP)

( * ) Notice: Subject to any disclaimer, the term of this patent is extended or adjusted under 35 U.S.C. 154(b) by 917 days.

(21) Appl. No.: 11/757,847

(22) Filed: Jun. 4, 2007

(65) Prior Publication Data

US 2007/0280744 A1 Dec. 6, 2007

(30) Foreign Application Priority Data

Jun. 2, 2006 (JP) ..... 2006-155103

(51) Int. Cl.
*G03G 15/09* (2006.01)

(52) U.S. Cl. ..... 399/269; 399/274; 399/275; 399/279; 399/283; 399/359

(58) Field of Classification Search ..... 399/120, 399/258, 267, 269, 274–275, 279, 283, 359
See application file for complete search history.

(56) References Cited

U.S. PATENT DOCUMENTS 4,267,201 A * 5/1981 Nakahara et al. ..... 430/122.1
5,557,371 A * 9/1996 Tooda ..... 399/159
5,987,288 A * 11/1999 Mori et al. ..... 399/269
6,243,543 B1 * 6/2001 Nozawa ..... 399/55
6,813,462 B2 * 11/2004 Mitsuya et al. ..... 399/269
7,090,956 B2 * 8/2006 Suzuki et al. ..... 430/122.1
7,260,347 B2 * 8/2007 Tamaki et al. ..... 399/269
7,286,790 B2 * 10/2007 Preston et al. ..... 399/257
7,305,206 B2 * 12/2007 Hart et al. ..... 399/256
7,593,671 B2 * 9/2009 Ishikawa et al. ..... 399/254

(Continued)

FOREIGN PATENT DOCUMENTS

JP 07-225512 8/1995

(Continued)

OTHER PUBLICATIONS

U.S. Appl. No. 12/251,580, filed Oct. 15, 2008, Nakayama et al.

(Continued)

*Primary Examiner* — David Gray
*Assistant Examiner* — Geoffrey Evans
(74) *Attorney, Agent, or Firm* — Oblon, Spivak, McClelland, Maier & Neustadt, L.L.P.

(57) ABSTRACT

A development apparatus includes a first developer chamber configured to store and supply the developer, a first developer bearer configured to convey the developer supplied from the first developer chamber to a first development domain, defined by a portion of the first developer bearer facing a latent image bearer, to develop the latent image, a second developer bearer configured to convey the developer passed through the first development domain to a second development domain, defined by a portion of the second developer bearer facing the latent image bearer, to develop the latent image, a second developer chamber configured to recover the developer passing through the second development domain and store the recovered developer, and a transfer prevention member provided between the second developer chamber and the second developer bearer to reduce a transfer of the developer from the second developer chamber to the second developer bearer.

14 Claims, 8 Drawing Sheets

U.S. PATENT DOCUMENTS

| | | | | |
|---|---|---|---|---|
| 7,702,261 | B2 * | 4/2010 | Yasuda | 399/254 |
| 2004/0105705 | A1 * | 6/2004 | Hirobe | 399/269 |
| 2004/0136755 | A1 * | 7/2004 | Kakimoto | 399/269 |
| 2005/0238390 | A1 * | 10/2005 | Fukuda | 399/267 |
| 2006/0008300 | A1 * | 1/2006 | Tanaka | 399/269 |
| 2007/0274742 | A1 * | 11/2007 | Nakayama et al. | 399/254 |
| 2008/0226355 | A1 * | 9/2008 | Koetsuka et al. | 399/277 |
| 2009/0067878 | A1 * | 3/2009 | Tateyama et al. | 399/111 |

FOREIGN PATENT DOCUMENTS

| | | |
|---|---|---|
| JP | 2000-155467 | 6/2000 |
| JP | 2001-249545 | 9/2001 |
| JP | 2003-263012 | 9/2003 |
| JP | 2004-163906 | 6/2004 |
| JP | 2006-139227 | 6/2006 |

OTHER PUBLICATIONS

U.S. Appl. No. 12/042,848, filed Mar. 5, 2008, Kita et al.

U.S. Appl. No. 12/059,392, filed Mar. 31, 2008, Tateyama et al.

Japanese Office Action issued Jul. 1, 2011, in Japanese Patent Application No. 2006-155103.

* cited by examiner

DEVELOPMENT APPARATUS HAVING TWO DEVELOPER BEARERS AND TWO DEVELOPMENT CHAMBERS

CROSS REFERENCE TO RELATED APPLICATIONS

The present patent application claims priority under 35 U.S.C. §119 upon Japanese patent application No. 2006-155103, filed in the Japan Patent Office on Jun. 2, 2006, the content and disclosure of which is hereby incorporated by reference herein in its entirety.

BACKGROUND OF THE INVENTION

1. Field of the Invention

Example embodiments generally relate to a development apparatus which develops a latent image on a latent image bearer with a developer which is supported by two developer bearers, and an image forming apparatus using the development apparatus.

2. Discussion of the Background

In a conventional development apparatus, a development roller supports a developer including toner and a magnetic carrier, and the developer is conveyed by the roller to the development domain at which the development roller faces a latent image bearer. The development roller as a developer bearer has a development sleeve including a nonmagnetic pipe, which is rotated, and a magnet roller arranged inside the nonmagnetic pipe, which is not rotated with the nonmagnetic pipe. The developer is stuck to the surface of the development sleeve by the magnetism of the magnet roller. A magnetic brush is formed on the development sleeve by forming chains of a magnetic carrier in the developer using the magnetism. A tip of the magnetic brush is touched with the latent image bearer with rotation of the development sleeve, and thereby the toner on the magnetic brush is transferred to the latent image on the latent image bearer. Alternatively, the development sleeve may be fixed while rotating the magnet roller in the development sleeve.

The surface speed of latent image bearers such as photoconductors, tends to be increased more with an increase in the image formation speed in recent years. In such a high-speed image forming apparatus, if a development sleeve (or a magnet roller) is not rotated at a comparatively high speed, the amount of toner supplied to the development domain per unit time is insufficient, resulting in formation of low density images. However, if the development sleeve is rotated at comparatively high speed, wearing of the latent image bearer or the developer caused by friction between the magnetic brush and the latent image bearer becomes remarkable.

Therefore, a development apparatus using two or more development rollers, which develops a latent image on a latent image bearer, is proposed. This development apparatus includes a development chamber for developing a latent image, a first developer chamber containing the developer therein, and a second developer chamber containing the developer under the first developer chamber. The development chamber is provided beside the first developer chamber and the second developer chamber. The development chamber includes a first development roller and a second development roller under the first development roller. A first development sleeve of the first development roller supports the developer supplied from the first developer chamber beside the first development sleeve, and develops a latent image on a photoconductor serving as a latent image bearer. The developer after contributing to the development, passes through a first development domain between the first development sleeve and the photoconductor, and is transferred to the second development sleeve of the second development roller provided under the first development sleeve. Further, the developer is conveyed into the second development domain between the second development sleeve and the photoconductor with rotation of the second development sleeve, and the developer contributes to the development again. After the second contributing to the development, the developer is recovered into the second developer chamber beside the second development sleeve. The developer is then recovered into the first developer chamber.

SUMMARY OF THE INVENTION

An embodiment of the present invention is directed to a development apparatus and an image forming apparatus effectively reducing deterioration in forming an image. In example embodiments, a development apparatus includes a first developer chamber configured to store and supply the developer, a first developer bearer configured to convey the developer supplied from the first developer chamber to a first development domain, defined by a portion of the first developer bearer facing a latent image bearer, to develop the latent image on the latent image bearer with the developer, a second developer bearer configured to convey the developer passing through the first development domain to a second development domain, defined by a portion of the second developer bearer facing the latent image bearer, to develop the latent image on the latent image bearer with the developer, a second developer chamber configured to recover the developer passing through the second development domain and store the recovered developer, and a transfer prevention member provided between the second developer chamber and the second developer bearer to reduce a transfer of the developer from the second developer chamber to the second developer bearer.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
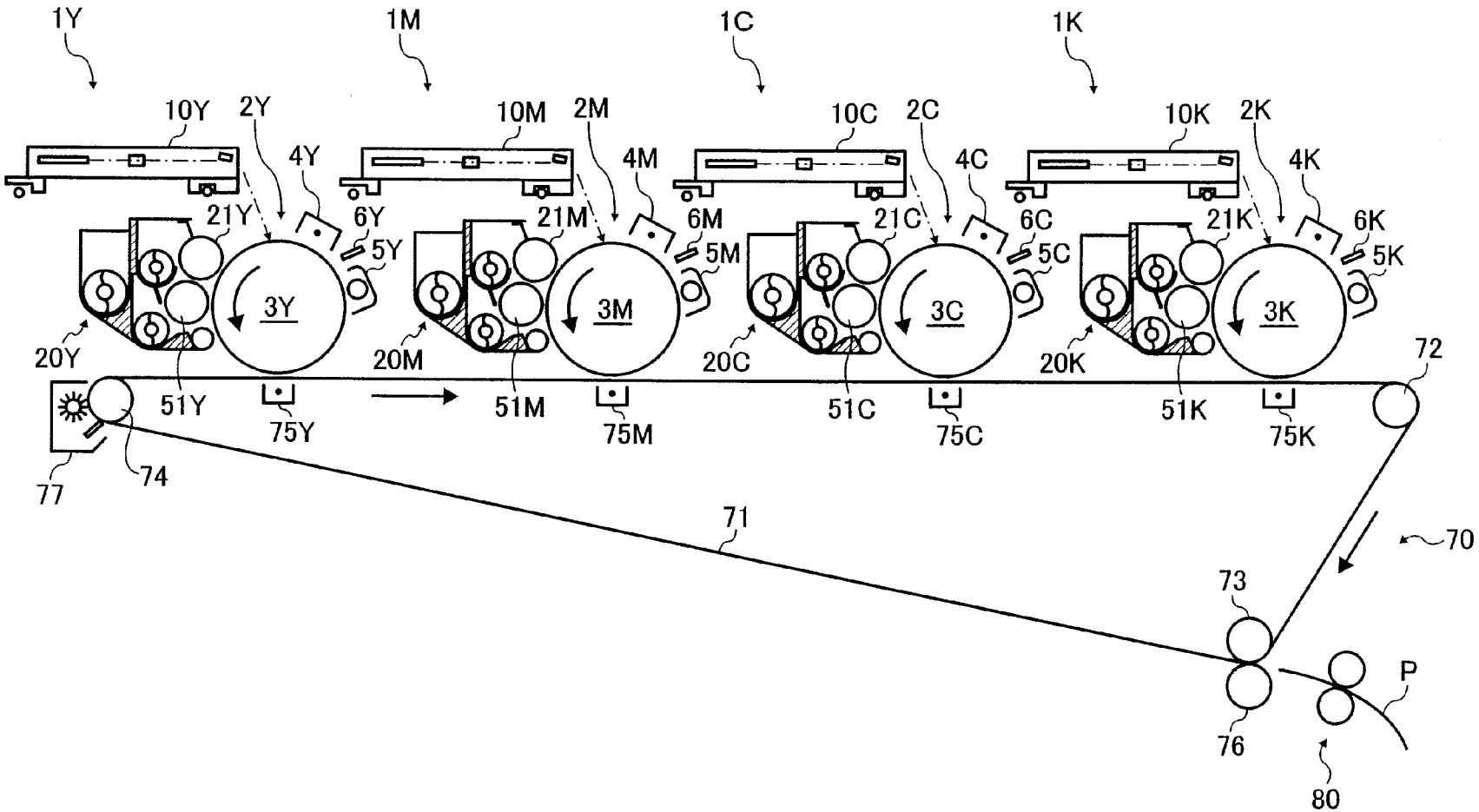
FIG. 1 is a cross-sectional diagram illustrating a main part of an image forming apparatus according to an example embodiment of the present invention.

In the following, it is understood that if an element or layer is referred to as being "on," "against," "connected to," or "coupled to" another element or layer, then it can be directly on, against, connected, or coupled to the other element or layer, or intervening elements or layers may be present. In contrast, if an element is referred to as being "directly on," "directly connected to," or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath," "below," "lower," "above," "upper," and the like, may be used herein for ease of description to describe one element or a feature's relationship to another element(s) or feature(s) as illustrated in the figures.

Also, it is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, terms such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts through the several views, particularly to FIG. 2, an example of a development apparatus according to example embodiments is explained.

An example of a color laser printer (or a printer) of an electrophotographic system is explained below as an image forming apparatus to which this invention is applied. FIG. 1 is a cross-sectional diagram illustrating a main part of an image forming apparatus according to an example embodiment of the present invention. The image forming apparatus includes four toner image formation parts 1Y, 1M, 1C, and 1K for forming toner image of each color as yellow, magenta, cyan, and black, respectively (the colors are described as Y, M, C, and K hereinafter). A transfer unit 70 is provided under the toner image formation parts 1Y, 1M, 1C, and 1K.

The toner image formation parts 1Y, 1M, 1C, and 1K have almost the same composition except for the colors. A toner image formation part 1Y for forming a Y toner image is explained. This toner image formation part 1Y has a process unit 2Y, an optical writing unit 10Y, and a development unit 20Y.

The process unit 2Y has an electrification equipment 4Y, a drum cleaning equipment 5Y, a neutralization lamp 6Y, etc. around a photoconductor 3Y having a shape of a drum rotated counterclockwise in FIG. 1. These components are held by a common casing, and it can be detached and attached to the main part of the printer. The photoconductor 3Y includes a pipe such as aluminum covered by an organic photosensitive layer.

The electrification equipment 4Y electrifies the surface of the photoconductor 3Y uniformly, for example, as a negative polarity by corona charge.

The optical writing unit 10Y includes a light source which is a laser diode etc., a polygon mirror of a right hexahedron, a polygon motor for rotating the polygon mirror, an fθ lens, a lens, a reflective mirror, etc. A laser light L ejected from the light source driven based on an image information sent from a personal computer which is not illustrated is reflected on the polygon mirror. The laser light L reaches the photoconductor 3Y, being deflected with rotation of the polygon mirror. An optical scan of the surface of the photoconductor 3Y is carried out, and an electrostatic latent image of Y is formed on the surface of the photoconductor 3Y.

The development unit 20Y includes a first development roller 21Y and a second development roller 51Y which expose a part of their surface through an opening of a casing. These development rollers include a development sleeve which is a non-magnetic pipe rotated by a drive means, which is not illustrated, and a magnet roller inside the development sleeve, which is not rotated with the development sleeve, and is not illustrated. The development unit 20Y stores Y developer including a magnetic carrier and Y toner of minus electrostatic property which is not illustrated. A conveyance with churning of this Y developer is carried out by three conveyance screws, which are described later. A friction electrification of Y toner is realized. The development sleeves of the development rollers support Y toner, which are used for development of an image.

In a development domain between the development sleeve and the photoconductor 3Y, a development bias of negative polarity output from a power supply, which is not illustrated, is applied to the development sleeve. Between the development sleeve and the electrostatic latent images on the photoconductor 3Y, there is development potential, which carries out electrostatic movement of the Y toner, of negative polarity from the sleeve side to the latent image side. Furthermore, between the development sleeve and the uniform electrification area (non-image area) of the photoconductor 3Y, there is non-developing potential, which carries out electrostatic movement of the M toner, of negative polarity from the non-image area side to the sleeve side. The Y toner in the Y developer on the development sleeve departs from the sleeve due to the effect from the development potential, and transfers on the electrostatic latent image of the photoconductor 3Y. The electrostatic latent image on the photoconductor 3Y is developed by this transferring so that the Y toner image is formed. An intermediate transfer of the Y toner image from the photoconductor 3Y onto an intermediate transfer belt 71 of a transfer unit 70, which is described later, is carried out.

The development unit 20Y has a toner concentration sensor including an amplitude permeability sensor, which are not illustrated. This toner concentration sensor outputs the voltage according to an amplitude permeability of the Y developer kept in a developer recovering chamber, which is described later, of the development unit 20Y. The amplitude permeability of a developer may show good correlation with the toner concentration of a developer, so that a toner concentration sensor outputs the voltage according to the toner concentration. The value of this output voltage is sent to the toner supply control part which is not illustrated. This toner supply control part, is equipped with memory means such as a RAM. The voltage Vtref for Y, which is a targeted value of the output voltage from the toner concentration sensor of Y, and data of Vtref for M, C, and K in other development units, are stored in the memory. The value of the output voltage from the toner concentration sensor for Y is compared with Vtref for Y. In addition, Y toner concentration supply equipment, which is not illustrated, is driven by the time according to the comparison result, which controls the drive of the Y toner supply equipment. The toner supply equipment supplies Y toner into the developer recovering chamber of the development unit 20Y. Y toner of a proper quantity is supplied to the Y developer, which is reduced in toner concentration after development. Therefore, Y toner concentration of the Y developer in the development unit 20Y is maintained within the limits of a predetermined value. In addition, similar toner supply control is carried out in the development units 20M, 20C, and 20K.

The Y toner image developed on the photoconductor 3Y is transferred to the intermediate transfer belt 71, which is described later. A waste toner remains on the surface of the photoconductor 3Y after transferring toner to the intermediate transfer belt 71. This waste toner is removed by the drum cleaning equipment 5Y. Thus, a neutralization of the surface of the photoconductor 3Y, where the waste toner was removed, is carried out by the neutralization lamp 6Y, and the surface of the photoconductor 3Y is uniformly charged again.

Although the toner image formation part for 1Y was disclosed above in detail, M, C, and K toner images are also formed on the surface of photoconductors 3M, 3C, and 3K, respectively, in the toner image formation parts 1M, 1C, and 1K, respectively, by a similar process.

The transfer unit 70 is provided under the toner image formation parts 1Y, 1M, 1C, and 1K. This transfer unit 70 has a driving roller 72, a tension roller 73, and a driven roller 74 inside an endless intermediate transfer belt 71. Non-end movement of the intermediate transfer belt 71 is carried out in a clockwise rotation by rotation drive of the driving roller 72. An upper side surface of the intermediate transfer belt 71 can be in touch with the photoconductors 3Y, 3M, 3C, and 3K, which forms first transfer nips for Y, M, C, and K.

Inside the loop of the intermediate transfer belt 71, four transfer chargers 75Y, 75M, 75C, and 75K other than the three rollers mentioned above are provided. These transfer charger 75Y, 75M, 75C, and 75K are provided so that an electric charge is provided to a back side surface at the first transfer nip of the intermediate transfer belt 71. With this electric charge, a transfer electric field of a direction, which carries out electrostatic movement of the toner from the photoconductors 3Y, 3M, 3C, and 3K side to the surface of the belt side, is formed in the first transfer nips. In another embodiment, the transfer charger of a corona charge system is replaced with a transfer roller, which receives transfer bias.

Y, M, C, and K toner images on the photoconductors 3Y, 3M, 3C, and 3K are transferred from the photoconductor side to a surface of the belt in the first transfer nips by influence of nip pressure or transfer electric field. Further, these toner images are piled up on the intermediate transfer belt 71. Therefore, a four color superposition toner image (hereinafter four color toner image) is formed on the intermediate transfer belt 71.

A secondary transfer bias roller 76 is in touch with a surface of the intermediate transfer belt 71 at a position of the tension roller 73, which forms a secondary transfer nip. A secondary transfer bias is applied to this secondary transfer bias roller 76 by a voltage applying means including a power supply or wiring, which is not illustrated. A secondary transfer electric field is formed between the secondary transfer bias roller 76 and the grounded tension roller 72. The four color toner image formed on the intermediate transfer belt 71 moves into a secondary transfer nip with non-end movement of the belt.

This printer is equipped with a sheet paper cassette, which is not illustrated. The sheet paper cassette stores recording sheets P, which are piled up. The top recording sheet P is sent out to a feed way at a predetermined timing. The recording sheet P is held between registration rollers 80 provided at the end of the feed way.

The rotation drive of the registration rollers 80 is stopped when the recording sheet P reaches the registration rollers 80 and is held between the registration rollers 80. The registration rollers 80 send out the recording sheet P towards a secondary transfer nip with a timing synchronized with the four color toner image on the intermediate transfer belt 71. In the secondary transfer nip, the four color toner image on the intermediate transfer belt 71 is transferred onto the recording sheet P by an effect of the secondary transfer electric field or nip pressure, so that a full color image is formed on the recording sheet P. The recording sheet P on which the full color image was formed is discharged from the secondary transfer nip. Further, the recording sheet P is sent to a fixing equipment, which is not illustrated, and the full color image is fixed on the recording sheet P.

A waste toner remains on the surface of the intermediate transfer belt 71 after the secondary transfer of the image to the recording sheet P. This waste toner is removed by a belt cleaning equipment 77, which is in touch with the intermediate transfer belt 71 at a position of the driven roller 74.

Figure 2:
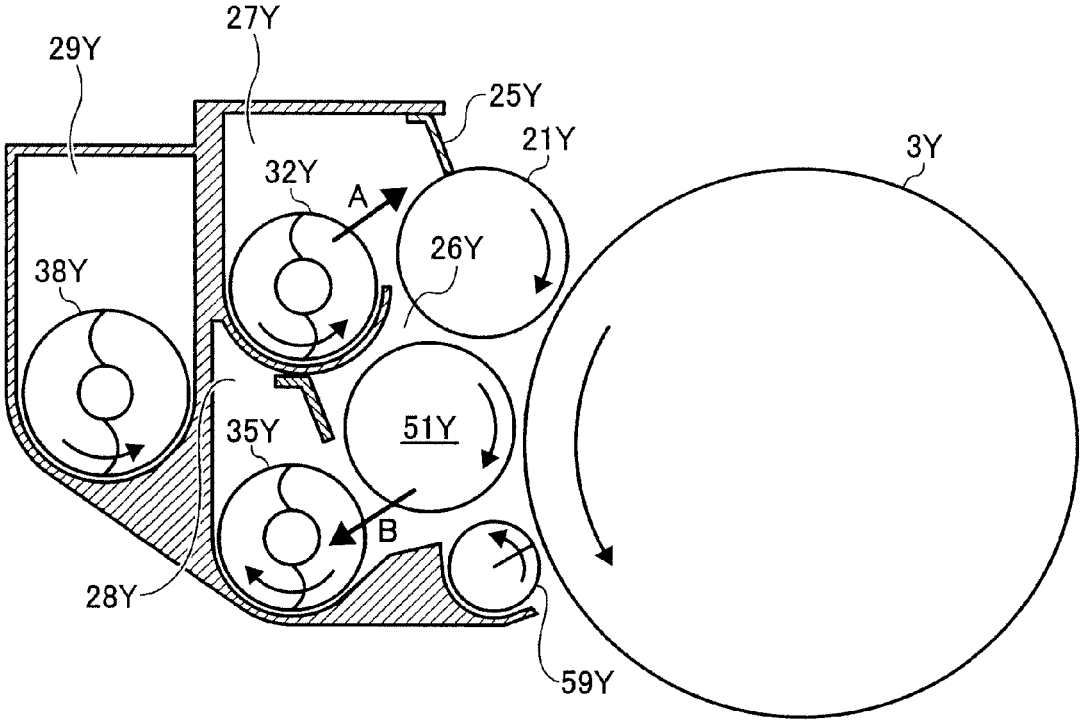
FIG. 2 is a cross-sectional diagram illustrating a development unit and a photoconductor of a toner image formation part of the image forming apparatus of FIG. 1.

FIG. 2 is a cross-sectional diagram illustrating a development unit 20Y and a photoconductor 3Y of a toner image formation part 1Y of the image forming apparatus of FIG. 1. The development unit 20Y includes a development chamber 26Y, a developer supplying chamber 27Y as a first developer chamber, a developer recovering chamber 28Y as a second developer chamber, and a developer returning chamber 29Y. The Y developer, which is not illustrated, is stored in these chambers. The development chamber 26Y includes the first development roller 21Y and the second development roller 51Y, which are provided so that they can be rotated. A supply conveyance screw 32Y is provided in the developer supplying chamber 27Y so that the supply conveyance screw 32Y can be rotated. A receiving conveyance screw 35Y is provided in the developer recovering chamber 28Y so that the receiving conveyance screw 35Y can be rotated. An inclination conveyance screw 38Y is provided in the developer returning chamber 29Y so that the inclination conveyance screw 38Y can be rotated.

Each of the first development roller 21Y and the second development roller 51Y includes a development sleeve, which is a non-magnetic pipe rotated clockwise by a drive means, which is not illustrated, and a magnet roller inside the development sleeve, which is not rotated with the development sleeve, and is not illustrated.

The development chamber 26Y has an opening in the side of the wall facing the photoconductor 3Y. A part of the development sleeves of both of the development rollers are exposed through the opening. The developer can move between the development chamber 26Y, the developer supplying chamber 27Y, and the developer recovering chamber 28Y. The developer supplying chamber 27Y is provided over the developer recovering chamber 28Y.

Figure 3:
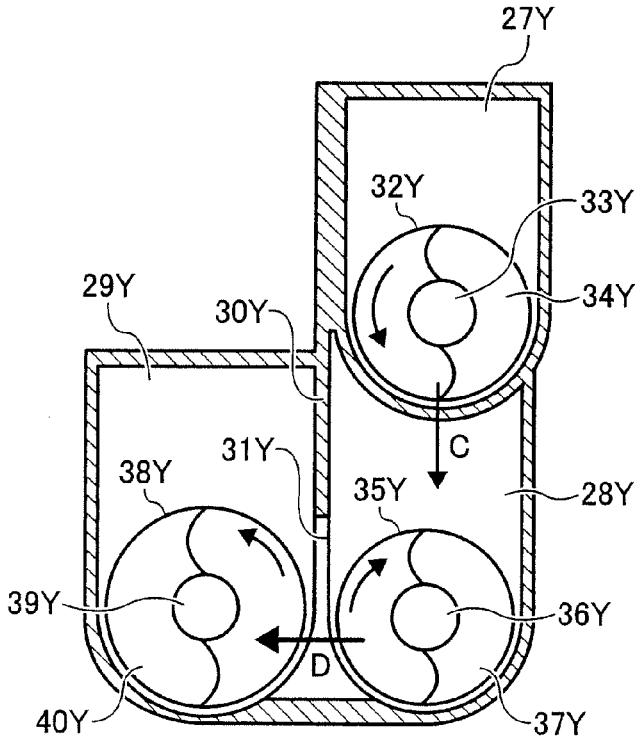
FIG. 3 is a cross-sectional diagram illustrating a one end of the development unit of the image forming apparatus of FIG. 1.

FIG. 3 is a cross-sectional diagram illustrating one end of the development unit of the image forming apparatus of FIG. 1. The supply conveyance screw 32Y is approximately parallel to the photoconductor 3Y of FIG. 2 and the development rollers. As shown in FIG. 3, a rotating shaft 33Y and a screw 34Y, which is provided spirally over the rotating shaft 33Y, are rotated counterclockwise by a non-illustrated driving means such as a motor.

The receiving conveyance screw 35Y is also approximately parallel to the photoconductor 3Y and the development rollers. As shown in FIG. 3, a rotating shaft 36Y and a screw 37Y, which is provided spirally over the rotating shaft 36Y, are rotated clockwise by a non-illustrated driving means such as a motor.

A developer returning chamber 29Y is provided beside the developer supplying chamber 27Y and the developer recovering chamber 28Y on the opposite side of the development chamber 26Y of FIG. 2. The developer returning chamber 29Y is inclined to other chambers. A rotating shaft 39Y and a screw 40Y, which is spirally provided on the rotating shaft 39Y, are rotated counterclockwise by a non-illustrated driving means such as a motor. The rotating shaft 39Y and the screw 40Y are also inclined to other chambers. The majority portion of the developer returning chamber 29Y is separated from the developer supplying chamber 27Y and the developer recovering chamber 28Y by a partition wall 30Y. However, the developer can move between the developer returning chamber 29Y, the developer supplying chamber 27Y, and the developer recovering chamber 28Y through partial openings provided in the partition wall 30Y.

In the developer supplying chamber 27Y, non-illustrated Y developer stored with the supply conveyance screw 32Y is conveyed from a front to back side of the figure with a rotation of the supply conveyance screw 32Y. In this conveyance process, the Y developer is supplied to the development sleeve (hereinafter a first development sleeve) of the first development roller 21Y in the development chamber 26Y as shown by an arrow A in FIG. 2. Further, the Y developer is caught on the first development sleeve by a magnetism of the magnet roller in the first development sleeve.

A layer thickness of the Y developer on the first development sleeve is controlled with a doctor blade 25Y, which faces a surface of the first development sleeve having a predetermined gap between them. Further, the Y developer is conveyed into the first development domain, which faces the photoconductor 3Y, and contributes to the development of the image.

The Y developer, which is not moved to the first development sleeve, is conveyed to a downstream supply conveyance screw 32Y. Further, the Y developer is dropped into the developer recovering chamber 28Y through an opening provided at a bottom of the developer supplying chamber 27Y as shown by an arrow C in FIG. 3.

In FIG. 2, the Y developer, which contributes to the development of the first development domain, at which the first development sleeve faces the photoconductor 3Y, passes through the first development domain with a rotation of the first development sleeve. Further, the Y developer is transferred to the development sleeve (hereinafter a second development sleeve) of the second development roller 51Y provided under the first development roller 21Y. Furthermore, the Y developer is conveyed to the second development domain, which faces the photoconductor 3Y with a rotation of the second development sleeve, and contributes to development again. The Y developer, after the second contributing development, is conveyed to a position where the developer is movable between the development chamber 26Y and the developer recovering chamber 28Y. The Y developer is dropped into the developer recovering chamber 28Y as shown by an arrow B in FIG. 2 after separating from the surface of the second development sleeve by an effect of the magnetic field formed by a magnetic roller of the second development roller 51Y.

A part of the Y developer, which is separated from the second development sleeve and is away from the developer recovering chamber 28Y after passing through the second development domain, is conveyed into the developer recovering chamber 28Y with a rotation of a recovery roller 59Y provided under the second development sleeve.

In the developer recovering chamber 28Y, the non-illustrated Y developer stored with the receiving conveyance screw 35Y is conveyed from a front to back side of FIG. 3 with a rotation of the receiving conveyance screw 35Y. With this conveyance process, the Y developer is supplied with the supply equipment described above. The developer recovering chamber 28Y receives the Y developer dropped through the openings from the developer supplying chamber 27Y. The Y developer, which is conveyed to a downstream of the receiving conveyance screw 35Y, is further conveyed to the developer returning chamber 29Y through the openings 31Y of the partition wall 30Y as shown by an arrow D in FIG. 3.

Figure 4:
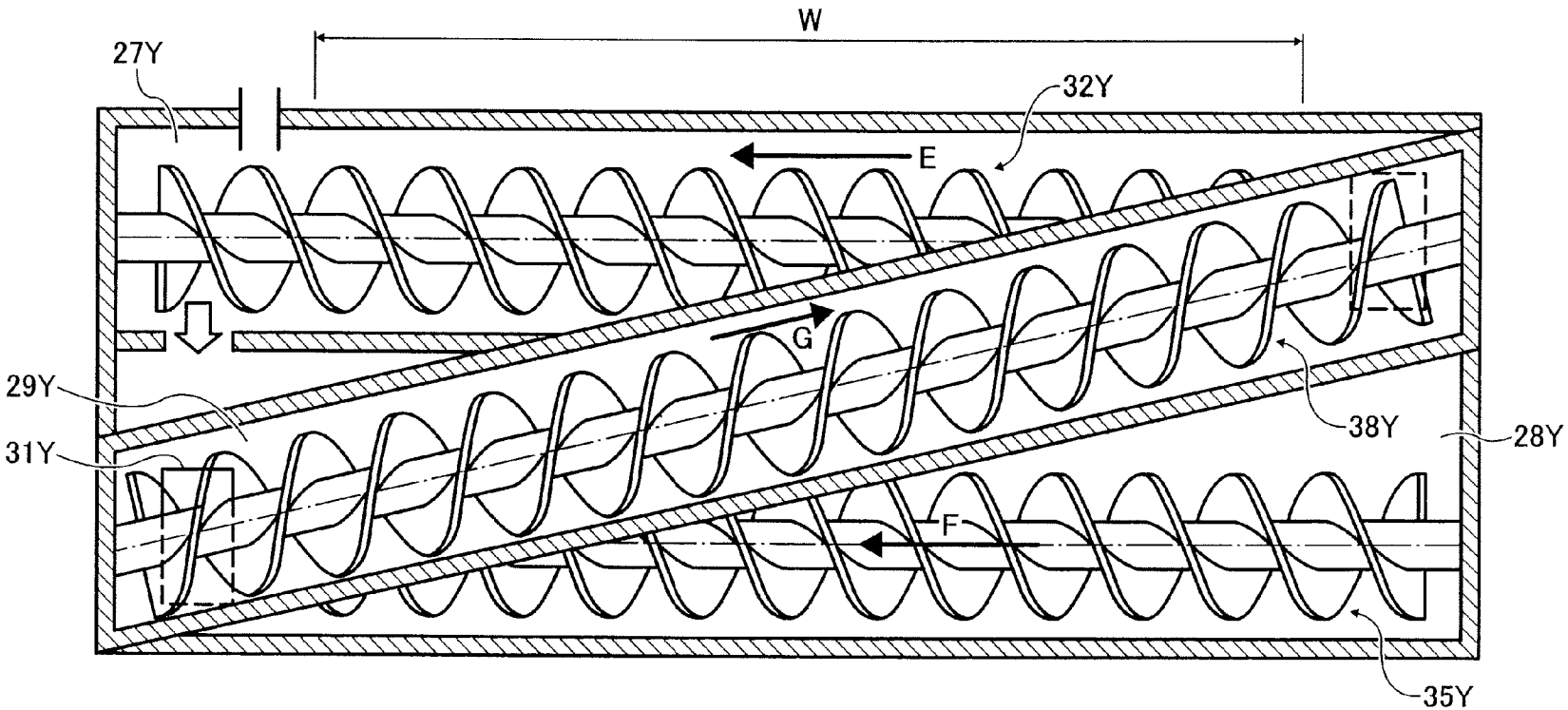
FIG. 4 is a side view illustrating the development unit of the image forming apparatus of FIG. 1.
Figure 5:
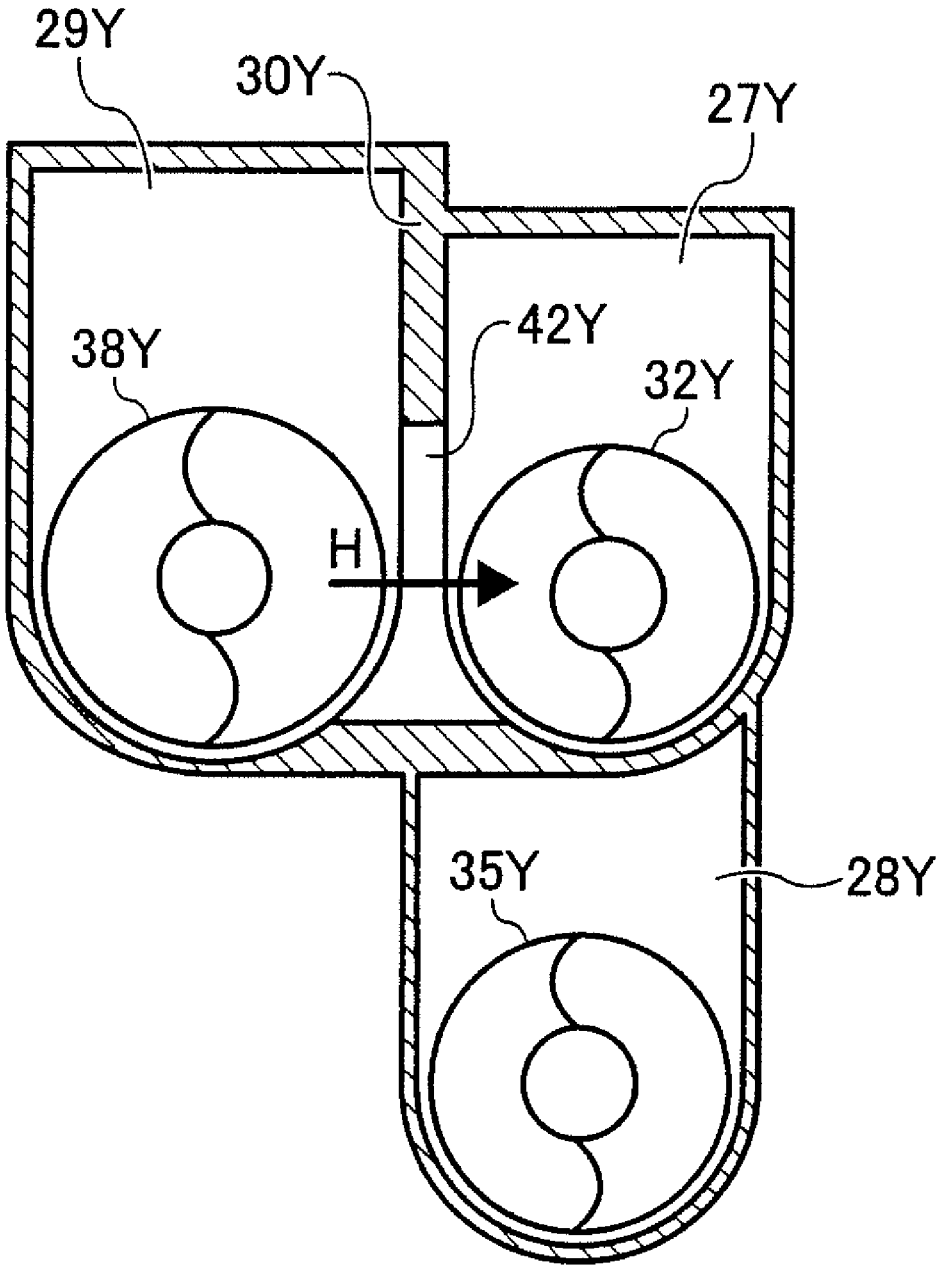
FIG. 5 is a cross-sectional diagram illustrating the other end of the development unit of the image forming apparatus of FIG. 1.

FIG. 4 is a side view illustrating the development unit of the image forming apparatus of FIG. 1. FIG. 5 is a cross-sectional diagram illustrating the other end of the development unit of the image forming apparatus of FIG. 1. The Y developer is conveyed into the developer returning chamber 29Y at a portion upstream from the inclination conveyance screw 38Y. The Y developer is conveyed along the inclination conveyance screw 38Y from a down part to an up part as shown by an arrow G in FIG. 4 with the rotation of the inclination conveyance screw 38Y. Further, the Y developer conveyed to the down stream portion of the inclination conveyance screw 38Y is returned back into the developer supplying chamber 27Y through an opening 42Y of the partition wall 30Y as shown by an arrow H in FIG. 5. The Y developer is conveyed to an upstream portion of the supply conveyance screw 32Y as shown by an arrow E in FIG. 4. Additionally, when the Y developer is in the recovering chamber 28Y, the Y developer is conveyed to an upstream portion of the receiving conveyance screw 35Y as shown by an arrow F in FIG. 4. The domain shown in FIG. 4 with mark W shows the image formation region in the longitudinal direction of the photoconductor.

In the above-described printer, the four photoconductors 3Y, 3M, 3C, and 3K function as a latent image bearer, which supports a latent image on its surface with a rotation of a non-end movement. The optical writing units 10Y, 10M, 10C, and 10K function as a latent image formation means to form a latent image on the photoconductor surface after uniform electrification. The development units 20Y, 20M, 20C, and 20K function as a development equipment, which develops the latent image on the photoconductors 3Y, 3M, 3C, and 3K, respectively. A combination of the developer returning chamber 29Y and the inclination conveyance screw 38Y, etc. functions as a Y developer returning back means which conveys the Y developer to the upstream portion of the developer supplying chamber 27Y as a first developer chamber after receiving the Y developer conveyed to downstream portion of the developer recovering chamber 28Y as a second developer chamber.

Figure 6:
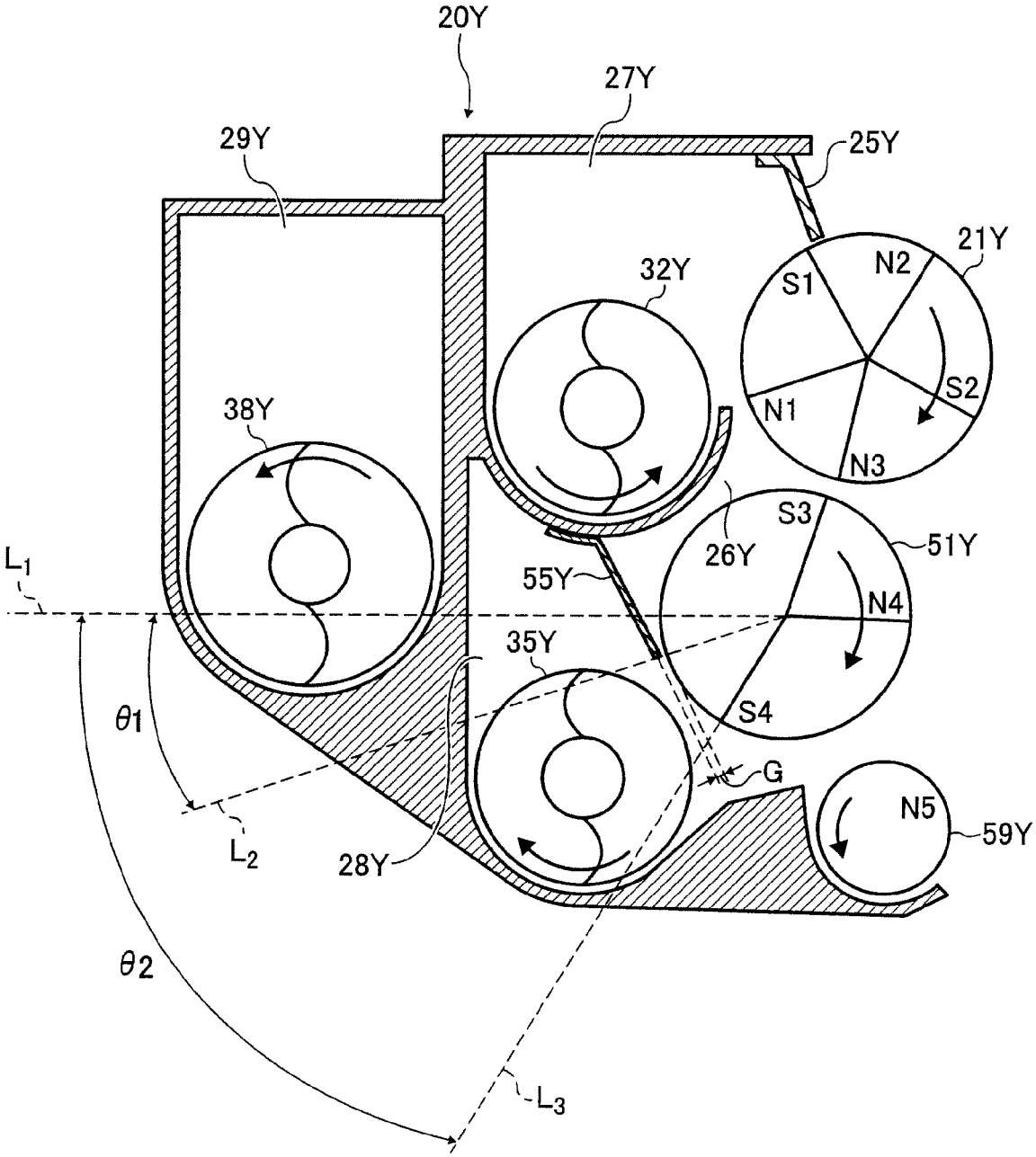
FIG. 6 is a cross-sectional diagram illustrating the development unit of the image forming apparatus of FIG. 1.

FIG. 6 is a cross-sectional diagram illustrating the development unit 20Y of the image forming apparatus of FIG. 1. The magnet roller of the first development roller 21Y has five magnetic poles called magnetic pole S1, magnetic pole N2, magnetic pole S2, magnetic pole N3, and magnetic pole N1 located clockwise from a facing position with the supply conveyance screw 32Y. The Y developer in the developer supplying chamber 27Y is configured to stick to the first development sleeve surface by the magnetism, which the S1 magnetic pole emits. The Y developer, stuck to the first development sleeve, is conveyed from the inside of the developer supplying chamber 27Y with rotation of the first development sleeve. Further, the Y developer reaches a facing position with the magnetic pole S2 through a facing position with the magnetic pole N2. The Y developer stands and forms a magnetic brush with the magnetism, which the magnetic pole S2 emits. The magnetic brush contributes to development in the first development domain. Further, the Y developer is conveyed to a facing position with the second development roller 51Y.

At the facing position, a repelling magnetic field is formed by the magnetic pole N3 and the magnetic pole N1. The Y developer on the first development sleeve is separated from the first development sleeve surface by the effect of the repelling magnetic field. After sticking to the second development sleeve surface due to magnetism, which the magnetic pole S3 of the magnet roller of the second development roller 51Y emits, the Y developer is moved with the second development sleeve.

The magnet roller of the second development roller 51Y has three magnetic poles called magnetic pole S3, magnetic pole N4, and magnetic pole S4, which are positioned from each other in a clockwise direction. The Y developer on the second development sleeve stands and forms a magnetic brush at a position facing the magnetic pole N4 with the magnetism which the magnetic pole N4 emits. The magnetic brush contributes to development in the second development domain. Further, the Y developer is conveyed to a position where the magnetism of S4 does not reach very much after passing through the second development domain. The Y developer on the second development sleeve is separated from the second development sleeve surface. After this separation, the Y developer is conveyed into the developer recovering chamber 28Y with a taper provided at the bottom of the development chamber 26Y or with rotation of the recovery roller 59Y having magnetic pole N5.

According to one embodiment of this printer, a height of the second development roller 51Y and a height of the receiving conveyance screw 35Y overlap each other. This configuration can decrease a vertical interval between the second development roller 51Y and the developer recovering chamber 28Y, so that a miniaturization of the height direction of the development unit 20Y can be attained.

However, in such a layout, the second development roller 51Y and the developer recovering chamber 28Y have a short distance between them comparatively, so that the Y developer conveyed into the developer recovering chamber 28Y, after separating from the second development sleeve, can easily stick to the developer recovering chamber 28Y again. If this sticking occurs again, which causes a decrease of the toner concentration, the Y developer is sent again into the second development domain in its current state, and an unevenness of the development concentration occurs.

In addition, in spite of appropriately controlling the amount of the developer conveyed to the first development domain by the doctor blade 25Y, the Y developer stuck to the second development sleeve, which is added to the proper quantity of the Y developer, is also conveyed to the second development domain. This conveyance excessively increases the amount of the developer in the second development domain, which may cause a blocking of the Y developer between the second development sleeve and the photoconductor 3Y. Further, this conveyance may damage the second development sleeve or the photoconductor 3Y.

Therefore, a transfer prevention blade 55Y, which prevents the Y developer from transferring to the surface of the second development sleeve, is provided in the developer recovering chamber 28Y. A transferring of the Y developer to the surface of the second development sleeve is reduced using this transfer prevention blade 55Y, so that an unevenness of the development concentration is reduced. In addition, a possibility of breakage of the photoconductor 3Y or the second development sleeve by sending excessive Y developer into the second development domain may be reduced.

The tip of the transfer prevention blade 55Y is on a level lower than a line L1, which has the same height as a center of the second development roller 51Y. If the tip of the transfer prevention blade 55Y is higher than the line L, the removed Y developer transfers to the second development sleeve again, and the Y developer remains on the second development sleeve. A line L2 joins points of the tip of the transfer prevention blade 55Y and the center of the second development roller 51Y. The lines L1 and L2 make an angle θ1. The θ1 is set to 30 degrees or more. A line L3 is a border line between the magnetic pole S4 and the magnetic pole S3. The lines L1 and L3 make an angle θ2. The θ2 is set to be greater than θ1. Further, the θ1 is smaller than θ2 by 15° or more ($30° \leqq \theta 1 \leqq (\theta 2 - 15°)$). With this setup, the Y developer stuck to the second development sleeve in the developer recovering chamber 28Y is effectively reduced again.

In addition, a gap G between the tip of the transfer prevention blade 55Y and the second development sleeve is set to 1 mm or shorter. With this setup, the amount of Y developer, which passes through the gap G, is effectively reduced.

The transfer prevention blade 55Y is made of a non-magnetic material such as resins. If the transfer prevention blade 55Y is made of magnetic materials, the line of magnetic force from the magnet roller of the second development roller 51Y turns to the transfer prevention blade 55Y, and accelerates the Y developer to pass through the gap G.

If the Y developer, dropped on the taper wall of the bottom of the development chamber 26Y under the second development roller 51Y, increases in a large amount, a pressure toward a rotating direction of the sleeve caused by the Y developer increases at approximately a place of the tip of the transfer prevention blade 55Y. This may accelerate the Y developer through the gap G. Therefore, a rotating direction of the receiving conveyance screw 35Y is set to a clockwise direction so that the moving direction is opposite to that of the second development sleeve in a domain where the receiving conveyance screw 35Y faces the second development sleeve. In this configuration, the Y developer dropped from the second development sleeve onto the taper wall is moved with the rotation of the receiving conveyance screw 35Y so that the Y developer is removed from the second development sleeve.

Figure 7:
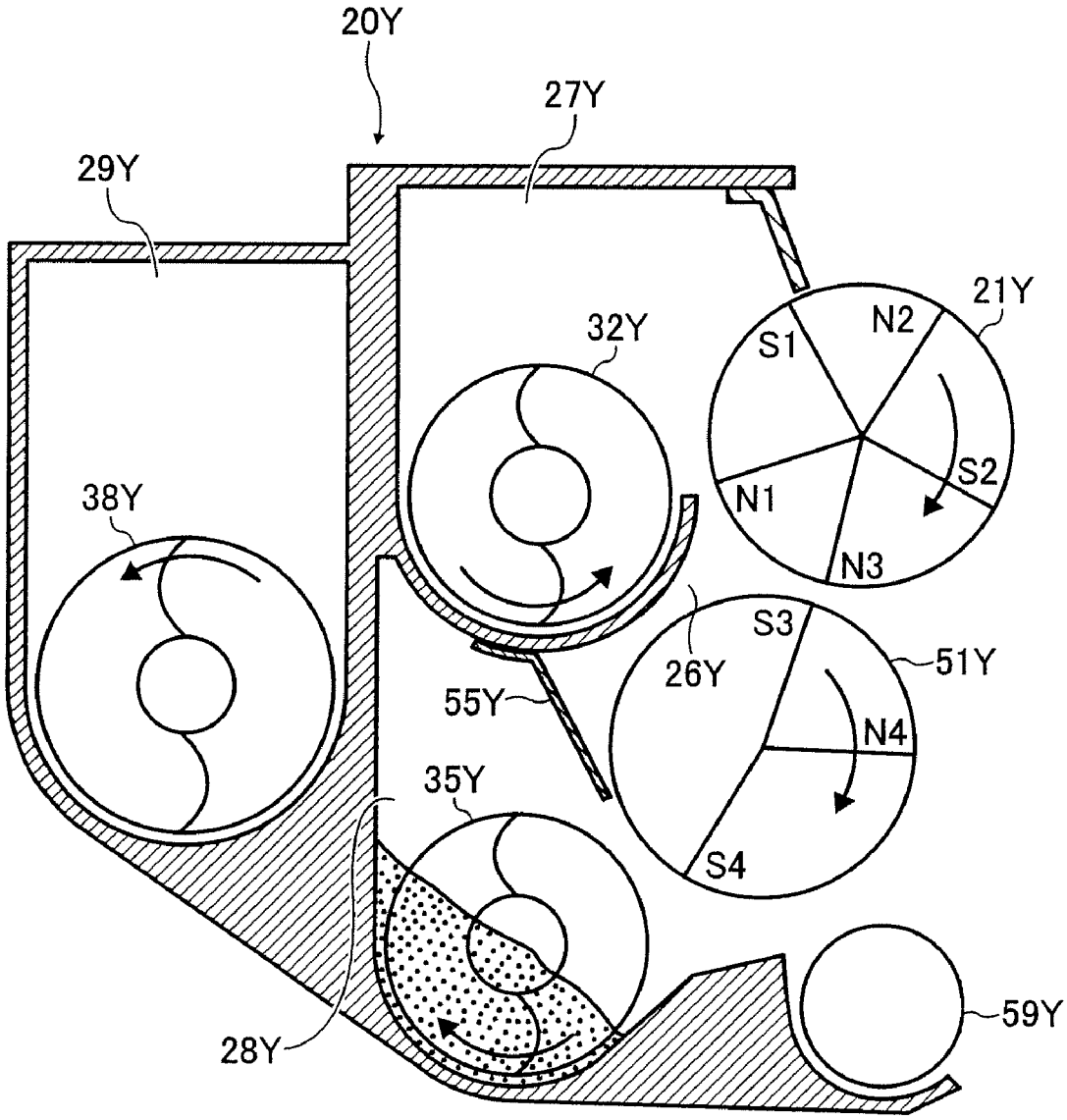
FIG. 7 is a cross-sectional diagram illustrating the development unit of the image forming apparatus of FIG. 1.

Therefore, a stagnation of the separated Y developer near the second development sleeve can be suppressed. FIG. 7 is a cross-sectional diagram illustrating the development unit of the image forming apparatus of FIG. 1. As shown in FIG. 7, most of the Y developer is kept in the receiving conveyance screw 35Y in an opposite position to the second development sleeve, so that the Y developer is moved into a domain of the receiving conveyance screw 35Y easily. Therefore, a stagnation of the Y developer near the second development sleeve is effectively suppressed.

Figure 8:
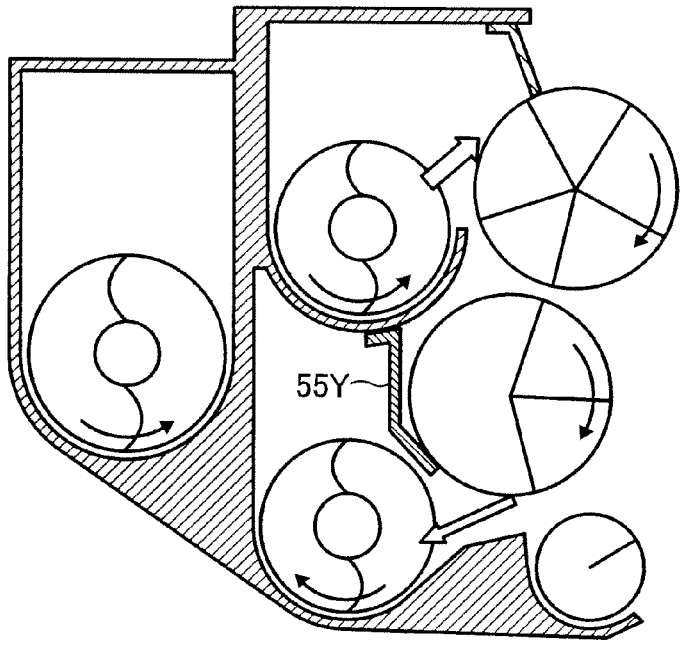
FIG. 8 is a cross-sectional diagram illustrating another example of the development unit of the image forming apparatus of FIG. 1.
Figure 9:
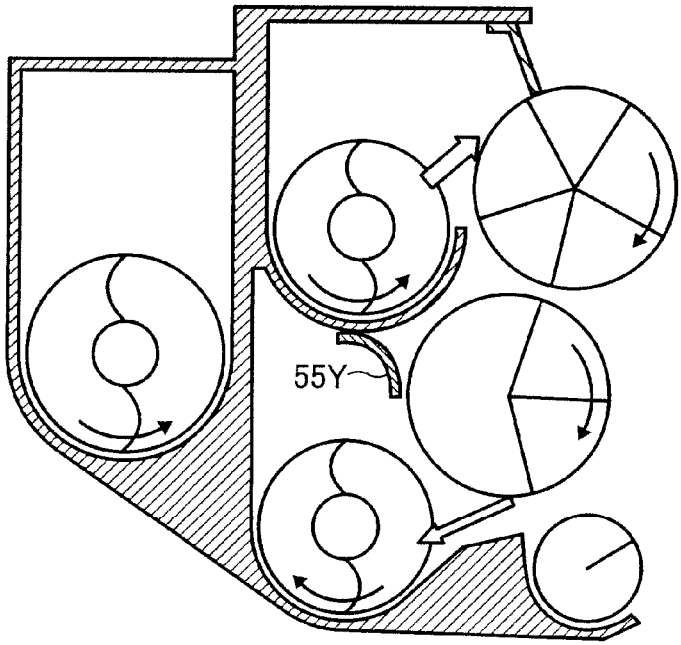
FIG. 9 is a cross-sectional diagram illustrating another example of the development unit of the image forming apparatus of FIG. 1.
Figure 10:
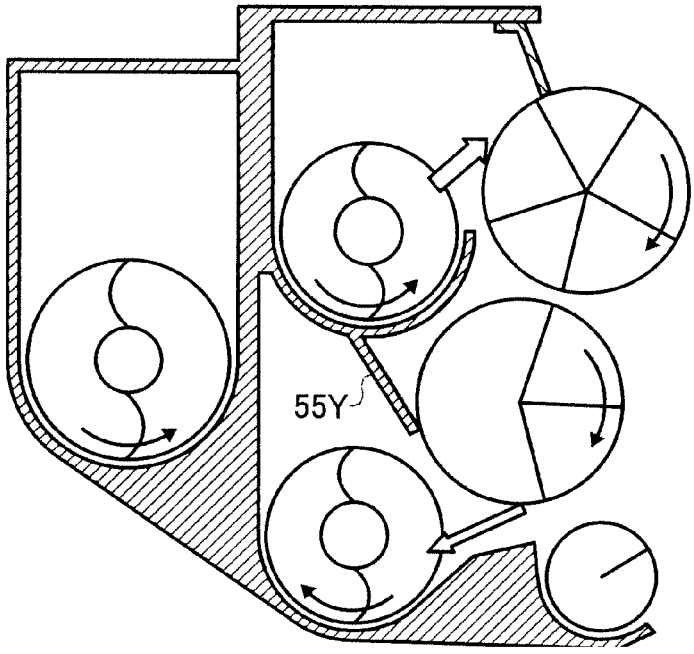
FIG. 10 is a cross-sectional diagram illustrating another example of the development unit of the image forming apparatus of FIG. 1.
Figure 11:
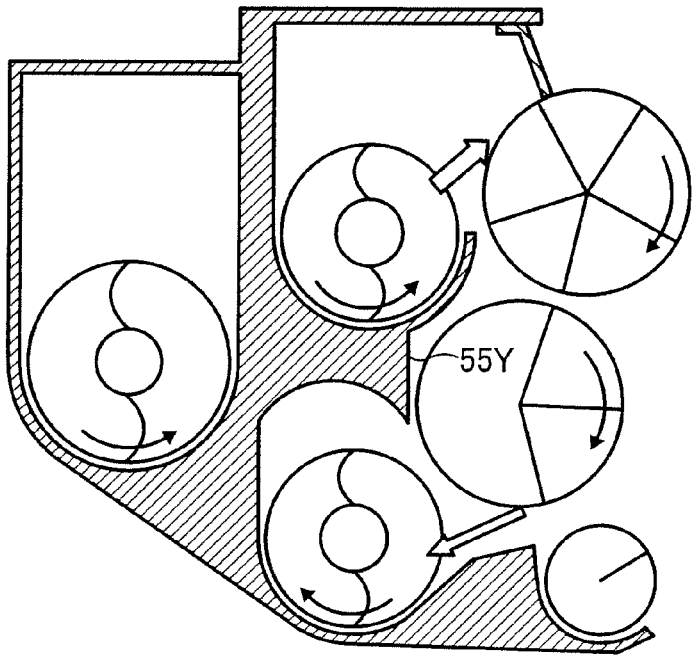
FIG. 11 is a cross-sectional diagram illustrating another example of the development unit of the image forming apparatus of FIG. 1.

FIG. 8 is a cross-sectional diagram illustrating another example of the development unit of the image forming apparatus of FIG. 1. The transfer prevention blade 55Y can be folded as shown in FIG. 8. FIG. 9 is a cross-sectional diagram illustrating another example of the development unit of the image forming apparatus of FIG. 1. The transfer prevention blade 55Y can be curved as shown in FIG. 8. FIG. 10 is a cross-sectional diagram illustrating another example of the development unit of the image forming apparatus of FIG. 1. The transfer prevention blade 55Y can be formed with a casing of the development unit 21Y as shown in FIG. 10. FIG. 11 is a cross-sectional diagram illustrating another example of the development unit of the image forming apparatus of FIG. 1. The transfer prevention blade 55Y can be formed with a casing of the development unit 21Y as shown in FIG. 11.

The development unit 20Y has been explained in detail. However, the development units 20M, 20C, and 20K also have the same composition as the development unit 20Y.

Although the full color printer as a tandem type printer has been explained, this invention can be applied to a full color printer as a single type printer. The single type printer includes two or more development means for each color provided around a latent image bearer such as a photoconductor. With selecting the development means, a visible image of each color formed on the latent image bearer is transferred onto an intermediate-transfer object one by one. This invention can also be applied to a single color printer.

This invention is not limited to the above-mentioned examples. It is clear that the form of each example described above may be suitably changed within the limits of this invention. Also, the number of components, a position, form, etc. are not limited to the form of each above-mentioned example, when carrying out this invention, they may have a suitable number, a position, form, etc.

Numerous additional modifications and variations are possible in light of the above teachings. It is therefore to be understood that within the scope of the appended claims, the disclosure of this patent specification may be practiced otherwise than as specifically described herein.

What is claimed:

1. A development apparatus configured to develop a latent image on a latent image bearer using a developer, which includes a toner and a carrier, the development apparatus comprising:

a first developer chamber configured to store and supply the developer;

a first developer bearer configured to convey the developer supplied from the first developer chamber to a first development domain, defined by a portion of the first developer bearer facing the latent image bearer, to develop the latent image on the latent image bearer with the developer;

a second developer bearer configured to convey the developer passing through the first development domain to a second development domain, defined by a portion of the second developer bearer facing the latent image bearer, to develop the latent image on the latent image bearer with the developer;

a second developer chamber configured to recover the developer passing through the second development domain and store the recovered developer;

a transfer prevention member provided between the second developer chamber and the second developer bearer to reduce a transfer of the developer from the second developer chamber to the second developer bearer;

a first conveyance member configured to convey the developer in the first developer chamber along a longitudinal direction of the first developer bearer; and a second conveyance member configured to convey the developer in the second developer chamber along a longitudinal direction of the second developer bearer, and to rotate in an opposite direction to a direction in which the second developer bearer rotates in a domain where the second conveyance member faces the second developer bearer, wherein the transfer prevention member is provided directly between the second developer bearer and the second conveyance member.

2. The development apparatus of claim 1, further comprising:

a developer returning member configured to receive the developer conveyed to a downstream portion of the second developer chamber relative to the developer conveying direction, and to return the developer to an upstream portion of the first developer chamber, wherein the first developer chamber is provided above the second developer chamber, and the first developer bearer is provided above the second developer bearer, and a height of the second developer bearer overlaps with a height of the second conveyance member when the second developer bearer and the second conveyance member are in a plane view.

3. The development apparatus of claim 2, wherein the second developer bearer includes a sleeve which rotates while bearing the developer on a surface thereof by magnetism of a magnet roller inside the sleeve.

4. The development apparatus of claim 3, wherein the transfer prevention member is made of a non-magnetic material.

5. The development apparatus of claim 3, wherein the second conveyance member includes a conveyance screw configured to convey the developer along a rotation shaft of the conveyance screw to allow the developer to move on the surface of the conveyance screw in a direction opposite to a direction of the developer fed by the sleeve in a domain where the conveyance screw faces the sleeve of the second developer bearer.

6. The development apparatus of claim 1, wherein a rotation direction of the second conveyance member is set to a clockwise direction so that a moving direction of the second conveyance member is opposite to that of the second developer bearer in the domain where the second conveyance member faces the second developer bearer so that a stagnation of the developer near the second developer bearer is suppressed.

7. The development apparatus of claim 1, wherein the first conveyance member is configured to rotate in a same tangential direction to a tangential direction in which the first developer bearer rotates in a domain where the first conveyance member faces the first developer bearer.

8. The development apparatus of claim 1, wherein a tip of the transfer prevention member extends below a horizontal line at a same height as a center of the second developer bearer; and an angle between the horizontal line at the same height as the center of the second developer bearer and a second line passing through the center of the second developer bearer and the tip of the transfer prevention member is at least 30 degrees.

9. The development apparatus of claim 1, wherein a portion of the transfer prevention member is directly above the second conveyance member.

10. An image forming apparatus, comprising:

a latent image bearer configured to bear a latent image thereon; and a development apparatus configured to develop the latent image with a developer including a toner and a carrier, wherein the development apparatus includes a first developer chamber configured to store and supply the developer;

a first developer bearer configured to convey the developer supplied from the first developer chamber to a first development domain, defined by a portion of the first developer bearer facing the latent image bearer, to develop the latent image on the latent image bearer with the developer;

a second developer bearer configured to convey the developer passing through the first development domain to a second development domain, defined by a portion of the second developer bearer facing the latent image bearer, to develop the latent image on the latent image bearer with the developer;

a second developer chamber configured to recover the developer passing through the second development domain and store the recovered developer;

a transfer prevention member provided between the second developer chamber and the second developer bearer to reduce a transfer of the developer from the second developer chamber to the second developer bearer;

a first conveyance member configured to convey the developer in the first developer chamber along a longitudinal direction of the first developer bearer; and a second conveyance member configured to convey the developer in the second developer chamber along a longitudinal direction of the second developer bearer, and to rotate in an opposite direction to a direction in which the second developer bearer rotates in a domain where the second conveyance member faces the second developer bearer, wherein the transfer prevention member is provided directly between the second developer bearer and the second conveyance member.

11. The image forming apparatus of claim 10, wherein the development apparatus further comprises a developer returning member configured to receive the developer conveyed to a downstream portion of the second developer chamber relative to the developer conveying direction, and to return the developer to an upstream portion of the first developer chamber, wherein the first developer chamber is provided above the second developer chamber, and the first developer bearer is provided above the second developer bearer; and a height of the second developer bearer overlaps with a height of the second conveyance member when the second developer bearer and the second conveyance member are in a plane view.

12. The image forming apparatus of claim 11, wherein the second developer bearer includes a sleeve that rotates while bearing the developer on a surface thereof by magnetism of a magnet roller inside the sleeve.

13. The image forming apparatus of claim 12, wherein the transfer prevention member is made of a non-magnetic material.

14. The image forming apparatus of claim 12, wherein the second conveyance member includes a conveyance screw configured to convey the developer along a rotation shaft of the conveyance screw to allow the developer to move on the surface of the conveyance screw in a direction opposite to a direction of the developer fed by the sleeve in a domain where the conveyance screw faces the sleeve of the second developer bearer.

* * * * *